US008628437B2

(12) United States Patent
Mollner et al.

(10) Patent No.: US 8,628,437 B2
(45) Date of Patent: Jan. 14, 2014

(54) HOCKEY STICK BLADE WITH RESILIENTLY COMPRESSIBLE CORE MEMBER

(75) Inventors: Brian C. Mollner, San Diego, CA (US); Joseph M. Omaña, III, San Diego, CA (US); Maxime Thouin, San Diego, CA (US); Jonathan J. Erredge, San Diego, CA (US)

(73) Assignee: True Temper Sports, Inc., Memphis, TN (US)

( * ) Notice: Subject to any disclaimer, the term of this patent is extended or adjusted under 35 U.S.C. 154(b) by 94 days.

(21) Appl. No.: 13/287,821

(22) Filed: Nov. 2, 2011

(65) Prior Publication Data

US 2012/0142460 A1 Jun. 7, 2012

Related U.S. Application Data

(60) Provisional application No. 61/419,555, filed on Dec. 3, 2010.

(51) Int. Cl.
*A63B 59/14* (2006.01)

(52) U.S. Cl.
USPC ..... 473/563

(58) Field of Classification Search
USPC ..... 473/560–563
See application file for complete search history.

(56) References Cited

U.S. PATENT DOCUMENTS

| | | | | | |
|---|---|---|---|---|---|
| 2,774,596 | A * | 12/1956 | Bredenberg | ..... | 473/561 |
| 4,124,208 | A * | 11/1978 | Burns | ..... | 473/562 |
| 4,343,468 | A * | 8/1982 | Lindgren | ..... | 473/563 |
| 4,488,721 | A * | 12/1984 | Franck et al. | ..... | 473/563 |
| 4,570,932 | A * | 2/1986 | Cote | ..... | 473/563 |
| 5,407,195 | A * | 4/1995 | Tiitola et al. | ..... | 473/563 |
| 5,676,608 | A * | 10/1997 | Christian et al. | ..... | 473/563 |
| 6,062,996 | A * | 5/2000 | Quigley et al. | ..... | 473/563 |
| 6,893,596 | B2 | 5/2005 | Haas et al. | | |
| 6,918,847 | B2 | 7/2005 | Gans et al. | | |
| 7,520,829 | B2 | 4/2009 | Mollner et al. | | |
| 7,862,456 | B2 | 1/2011 | Halko et al. | | |
| 7,963,868 | B2 | 6/2011 | Mcgrath et al. | | |
| 2001/0046909 | A1 * | 11/2001 | Pagotto | ..... | 473/563 |
| 2004/0235592 | A1 * | 11/2004 | McGrath et al. | ..... | 473/560 |
| 2005/0181897 | A1 * | 8/2005 | Chen et al. | ..... | 473/563 |
| 2009/0011876 | A1 * | 1/2009 | Mollner et al. | ..... | 473/563 |

* cited by examiner

*Primary Examiner* — Mark Graham
(74) *Attorney, Agent, or Firm* — Harness, Dickey & Pierce, P.L.C.

(57) ABSTRACT

A blade for a hockey stick includes a front face, a rear face, a first end operable to be connected to a blade connecting end of a handle portion, a second end that is opposite the first end, an upper edge that extends between the first and second ends, and a lower edge that extends between the first and second ends. The blade includes a resiliently compressible core member and a covering member that partially encases the resiliently compressible core member. The covering member defines an exterior surface of the blade and includes an opening on the lower edge of the blade that exposes the resiliently compressible core member.

20 Claims, 3 Drawing Sheets

HOCKEY STICK BLADE WITH RESILIENTLY COMPRESSIBLE CORE MEMBER

CROSS-REFERENCE TO RELATED APPLICATION

This application claims the benefit of U.S. Provisional Application No. 61/419,555, filed on Dec. 3, 2010. The entire disclosure of the above application is incorporated herein by reference.

FIELD

The present disclosure relates to a hockey stick and, more particularly, relates to a hockey stick blade with a resiliently compressible core member.

BACKGROUND

This section provides background information related to the present disclosure which is not necessarily prior art.

Blades for hockey sticks can be made out of a monolithic piece of material, such as wood. Hockey stick blades can also be made out of a composite material, such as high strength fibers (e.g., carbon fibers) that are embedded within a polymeric material (e.g., epoxy). In the later case, a pre-preg material is wrapped around a relatively stiff core member, and the pre-preg material is then cured (e.g., via heat) to form the hockey stick blade. The pre-preg material can be wrapped such that the fibers are in a predetermined orientation such that the hockey stick blade exhibits advantageous force distribution properties, stiffness, etc. This type of blade can be relatively low weight to such that the hockey stick can be maneuvered relatively quickly and easily.

SUMMARY

This section provides a general summary of the disclosure, and is not a comprehensive disclosure of its full scope or all of its features.

A blade for a hockey stick is disclosed that includes a front face, a rear face, a first end operable to be connected to a blade connecting end of a handle portion, a second end that is opposite the first end, an upper edge that extends between the first and second ends, and a lower edge that extends between the first and second ends. The blade includes a resiliently compressible core member and a covering member that partially encases the resiliently compressible core member. The covering member defines an exterior surface of the blade and includes an opening on the lower edge of the blade that exposes the resiliently compressible core member.

A method of manufacturing a blade for a hockey stick is also disclosed. The blade includes a front face, a rear face, a first end operable to be connected to a blade connecting end of a handle portion, a second end that is opposite the first end, an upper edge that extends between the first and second ends, and a lower edge that extends between the first and second ends. The method includes providing a resiliently compressible core member. The method also includes partially encasing the resiliently compressible core member with a covering member to define an exterior surface of the blade, and leaving the resiliently compressible core member exposed through an opening in the covering member on the lower edge of the blade.

Furthermore, a hockey stick is disclosed that includes a handle portion with a blade connecting end. The hockey stick also includes a blade including a front face, a rear face, a first end operable to be connected to the blade connecting end of the handle portion, a second end that is opposite the first end, an upper edge that extends between the first and second ends, and a lower edge that extends between the first and second ends. The blade further includes an elastomeric core member that includes a bottom rib and a front sheet. The bottom rib is disposed adjacent the lower edge of the blade, and the front sheet is adjacent to and extends along the front face of the blade. The blade additionally includes at least one rigid foam member and a covering member that at least partially encases the at least one rigid foam member and the elastomeric core member. The covering member defines an exterior surface of the blade. The covering member includes an opening on the lower edge of the blade that exposes the bottom rib of the elastomeric core member along the lower edge of the blade.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figures 1, 2:
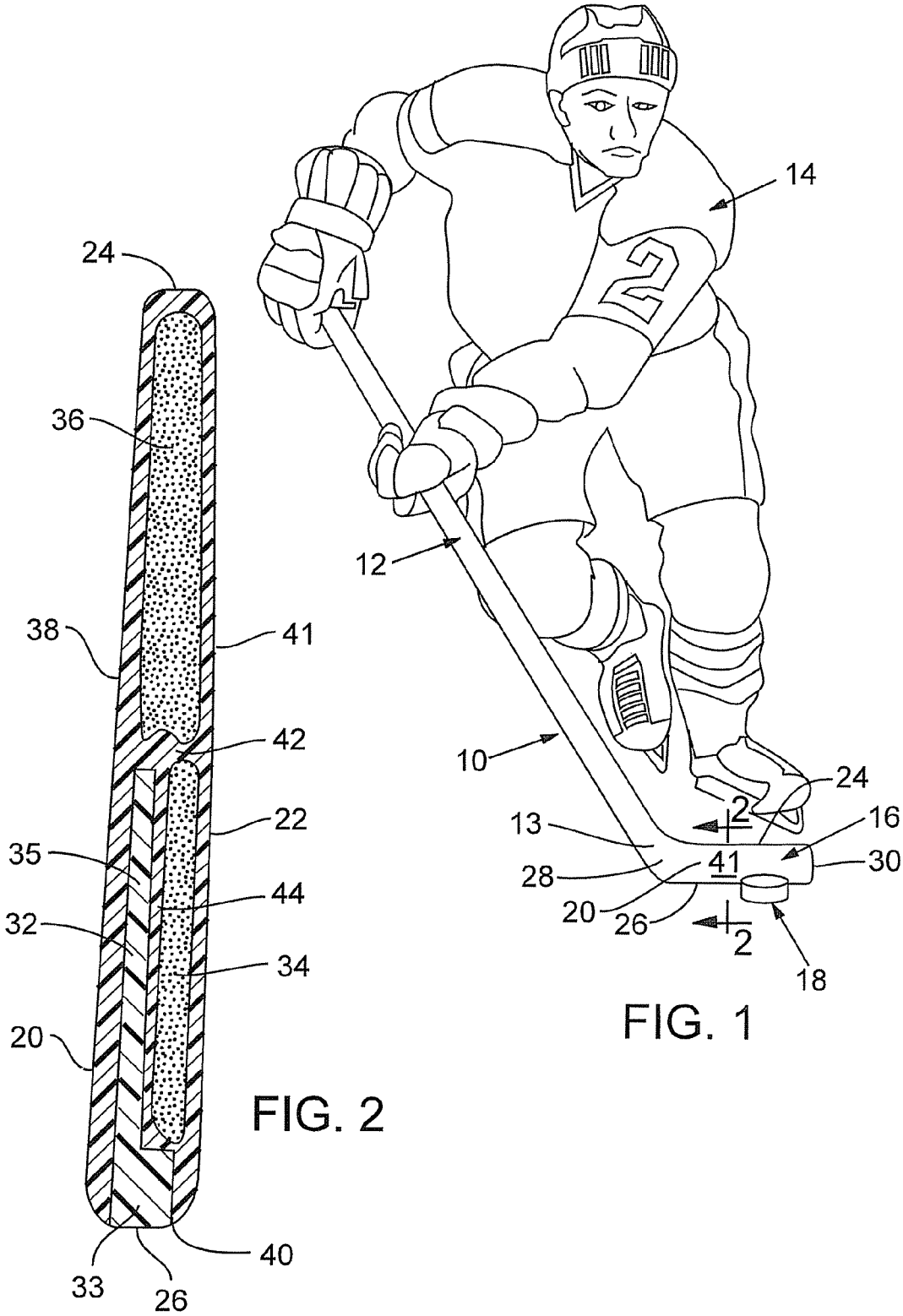
FIG. 1 is a front view of a hockey stick according to the teachings of the present disclosure.
FIG. 2 is a section view of the hockey stick taken along line 2-2 of FIG. 1.
Figure 3:
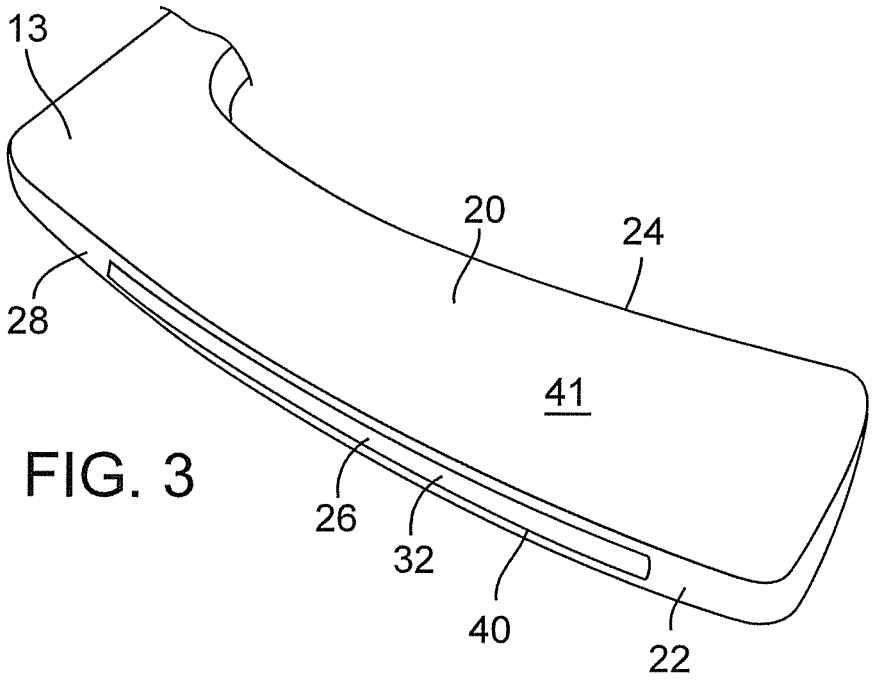
FIG. 3 is a perspective front view of a blade of the hockey stick of FIG. 1.
Figure 4:
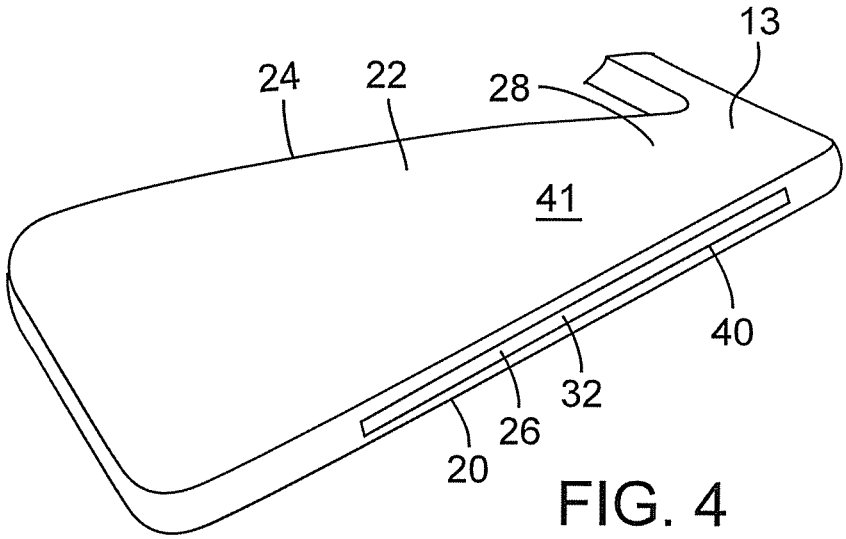
FIG. 4 is a perspective rear view of the blade of the hockey stick of FIG. 1.

Referring initially to FIG. 1, a hockey stick 10 is illustrated. The hockey stick 10 generally includes a handle portion 12, which a player 14 holds, and a blade portion 16 (i.e., blade), which is used for controlling a puck 18. As will be discussed below, the blade portion 16 can provide an improved feel and improved control of the hockey puck 18.

It will be appreciated that the hockey stick 10 can be adapted for any type of position on a hockey team, including that of a goalie, without departing from the scope of the present disclosure. It will also be appreciated that the teachings of the present disclosure can be applied for any other related type of sports equipment, such as a field hockey stick, etc.

The handle portion 12 will now be discussed in greater detail. The handle portion 12 can be elongate and longitudinally straight. In some embodiments, the handle portion 12 can include a hollow core that is embedded and wrapped within a covering (e.g., composite material with carbon fibers).

The handle portion 12 can include a blade connecting end 13. The blade portion 16 can be fixed to the blade connecting end 13 of the handle portion 12. The blade portion 16 can be fixed to the blade connecting end 13 in any suitable manner. It will be appreciated that the handle portion 12 and the blade portion 16 can be manufactured separately and subsequently attached together in a separate manufacturing process.

The construction and manufacture of the handle portion 12 and/or blade portion 16, the attachment of the blade portion 16 to the handle portion 12, and other features of the hockey stick 10 can be according to the teachings of U.S. Pat. No. 6,893,596, issued May 17, 2005 to Haas et al. and/or U.S. Pat. No. 7,520,829, issued Apr. 21, 2009 to Mollner et al. Each of these patents is incorporated by reference in its entirety.

The blade portion 16 will now be described with reference to FIGS. 1-4. As shown, the blade portion 16 can generally include a front face 20 (FIGS. 1-3), which is most often used for receiving and passing the puck 18, and a rear face 22 (FIGS. 2 and 4), which can also be used for receiving and passing the puck 18. Moreover, the blade portion 16 can include a first end 28 that is connected to the end 13 of the handle portion 12. The blade portion 16 can also include a second end 30 that is opposite to the first end 28. The blade portion 16 can additionally include a upper edge 24 that is typically spaced away from the playing surface (e.g., ice) and a lower edge 26 that often moves closely adjacent the playing surface. Both the upper and lower edges 24, 26 can extend between the first and second ends 28, 30 of the blade portion 16. Also, the upper and lower edges 24, 26 can have a slight curvature between the first and second ends 28, 30 such that the front face 20 is concave while the rear face 22 is convex.

As shown in FIG. 2, the blade portion 16 can include one or more core members 32, 34, 36 that is/are covered and at least partially encased by a covering member 38. As will be discussed, at least one of the core members 32, 34, 36 can be resiliently compressible such that the blade portion 16 resiliently compresses. In other words, the thickness of the blade portion 16 measured between the front and rear faces 20, 22 can vary due to this resilient compressibility. For instance, the blade portion 16 can resiliently compress when the puck 18 impacts the blade portion 16 (e.g., the player 14 receives a pass). As such, the impact energy can be dissipated, and the puck 18 is less likely to inadvertently bounce away from the blade portion 16. Thus, the hockey stick 10 can provide a greater amount of control of the puck 18.

Also, although the covering member 38 can define almost an entire outer surface 41 of the blade portion 16, the covering member 38 can include an opening 40 (FIGS. 2-4) on the lower edge 26 of the blade portion 16 that partially exposes the core member 32. As will be discussed, the opening 40 can facilitate resilient compression of the blade portion 16. Thus, the opening 40 can enhance puck control as well.

It will be appreciated that the hockey stick 10 can include any number of core members 32, 34, 36, and the core members 32, 34, 36 can be made out of any suitable material. Also, core members 32, 34, 36 can be included in any area of the hockey stick 10.

Figure 5:
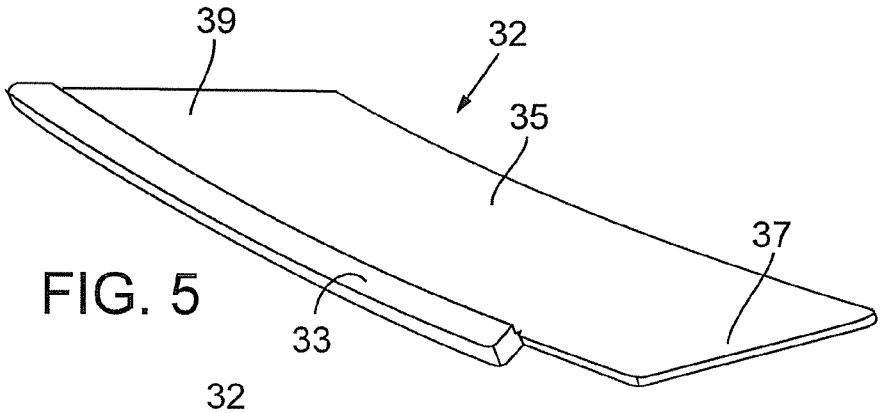
FIG. 5 is a perspective view of a resiliently compressible core member of the hockey stick of FIG. 1.
Figure 6:
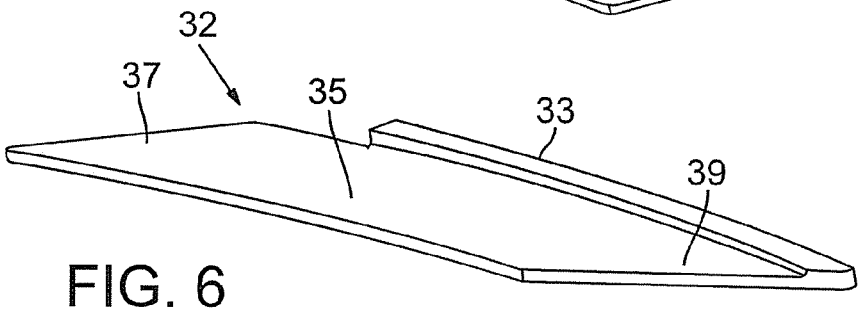
FIG. 6 is a perspective view of the resiliently compressible core member of the hockey stick of FIG. 1.

In the embodiments shown in FIG. 2, the hockey stick 10 can include a first core member 32. The shape of the first core member 32 can generally conform to the shape of the blade portion 16 of the hockey stick 10. As shown in FIGS. 5 and 6, the first core member 32 can be generally thin and sheet-like. Specifically, as shown in FIGS. 2, 5, and 6, the first core member 32 can include a bottom rib 33 and a front sheet 35, such that the first core member 32 has a substantially L-shaped cross section. As shown in FIG. 2, the bottom rib 33 can be disposed adjacent and can extend along the lower edge 26 of the hockey stick 10, and the front sheet 35 can be disposed adjacent and can extend along the front face 20 of the hockey stick 10. Moreover, as shown in FIGS. 5 and 6, the first core member 32 can include a rear portion 37 that extends past the bottom rib 33. A front portion 39 can be defined opposite the rear portion 37. The rear portion 37 can be disposed adjacent the first end 28 of the blade portion 16, and the front portion 39 can be disposed adjacent the second end 30 of the blade portion 16.

In some embodiments, the thickness of the first core member 32 can vary along its length. For instance, the rear portion 37 can be thicker than the front portion 39. Also, the thickness of the first core member 32 can gradually taper from the rear portion 37 to the front portion 39. In other embodiments, the thickness of the front sheet 35 can be substantially constant and/or the thickness of the rib 33 can be substantially constant.

The first core member 32 can be made out of a resiliently compressible material. For instance, the first core member 32 can be made from polyurethane, silicone, neoprene, rubber, or other elastomeric material. It will be appreciated, however, that the first core member 32 can be made out of any suitable material. In some embodiments, the first core member 32 can have a hardness between 70 on the Shore A scale and a 50 on the Shore D scale. Also, in some embodiments, the first core member 32 can have a hardness of 90 on the Shore A scale.

Furthermore, the hockey stick 10 can include a second core member 34 and a third core member 36. The second and third core members 34, 36 can each be elongate and thin with a substantially rectangular cross section (FIG. 2). The second core member 34 can be disposed in the space defined between the bottom rib 33 and front sheet 35 of the first core member 32, and the third core member 36 can be disposed above both the first and second core member 32, 34. Stated differently, the second core member 34 can overlap the front sheet 35 of the first core member 32 in a direction between the front and rear faces 20, 22, and the front sheet 35 can be disposed closer to the front face 20 than the second core member 34. Also, the third core member 36 can overlap the first core member 32 and the second core member 34 in a direction between the upper and lower edges 24, 26 of the blade portion 16, and the first and second core members 32, 34 can be disposed closer to the lower edge 26 than the third core member 36.

The second and third core members 34, 36 can be made of a relatively rigid, stiff, lightweight material, such as rigid foam. Thus, the second and third core members 34, 36 can provide added strength to the blade portion 16 without significantly increasing the weight of the blade portion 16.

The covering member 38 can be made out of a lightweight, high-strength composite material. For instance, the covering member 38 can include a plurality of carbon fibers that are woven and embedded within an epoxy or other matrix material. During manufacture of the hockey stick 10, pre-preg material can be wrapped around and laid over the core members 32, 34, 36 and then cured to form the covering member 38. However, the covering member 38 could be made out of any other material or in any other fashion.

As shown, the covering member 38 can also be wrapped so as to extend over and define the entire front face 20 of the blade portion 16, the entire upper edge 24, the entire rear face 22, and the entire second end 30. The covering member 38 can also connect to the handle portion 12 at the first end 28 of the blade portion 16. Furthermore, the covering member 38 can also cover only a portion of the lower edge 26 of the blade portion 16 such that the elongate opening 40 is defined along the lower edge 26 (see FIGS. 2-4). The opening 40 can have any suitable length, width, or other dimension. In the embodiments illustrated, the opening 40 is included only along the lower edge 26. For instance, the opening 40 can extend along substantially the entire bottom rib 33 of the first core member 32. Stated differently, the opening 40 exposes substantially an entirety of the bottom rib 33 of the first core member 32 along the lower edge 26 of the blade portion 16. As shown in FIG. 2, the bottom rib 33 is substantially flush with the surrounding portions of the outer surface 41.

Moreover, the covering member 38 can extend between the core members 32, 34, 36. For instance, a rib 42 can be disposed between the third core member 36 and the first and second core members 32, 34 to extend between the front and rear faces 20, 22. The rib 42 can increase stiffness and strength of the blade portion 16 (e.g., under shear loading). Also, an internal portion 44 of the covering member 38 can be disposed between the first and second core members 32, 34. The rib 42 and/or the internal portion 44 can be made of the same material as the other portions of the covering member 38 (i.e., can be integrally connected).

It will be appreciated that the covering member 38 can extend over any portion of the core members 32, 34, 36. Also, in some embodiments, the opening 40 is not included and the lower edge 26 is entirely covered by the covering member 38. Furthermore, the opening 40 can be arranged in any suitable location (e.g., along the front face 20). Moreover, the covering member 38 can be wrapped such that the high strength (e.g., carbon) fibers are disposed in any suitable orientation for increasing the strength of the hockey stick 10.

Figure 7A:
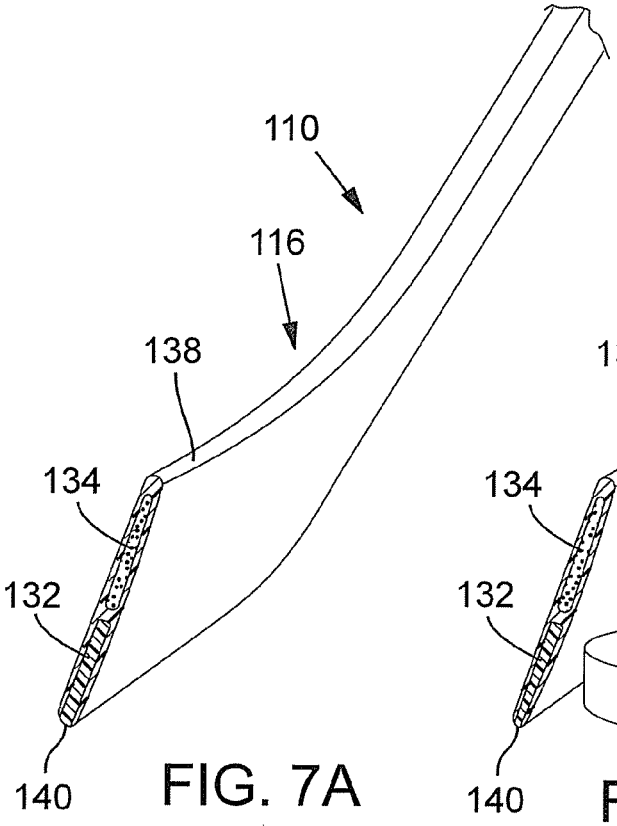
FIG. 7A is a section view of the hockey stick according to additional embodiments of the present disclosure.
Figure 7B:
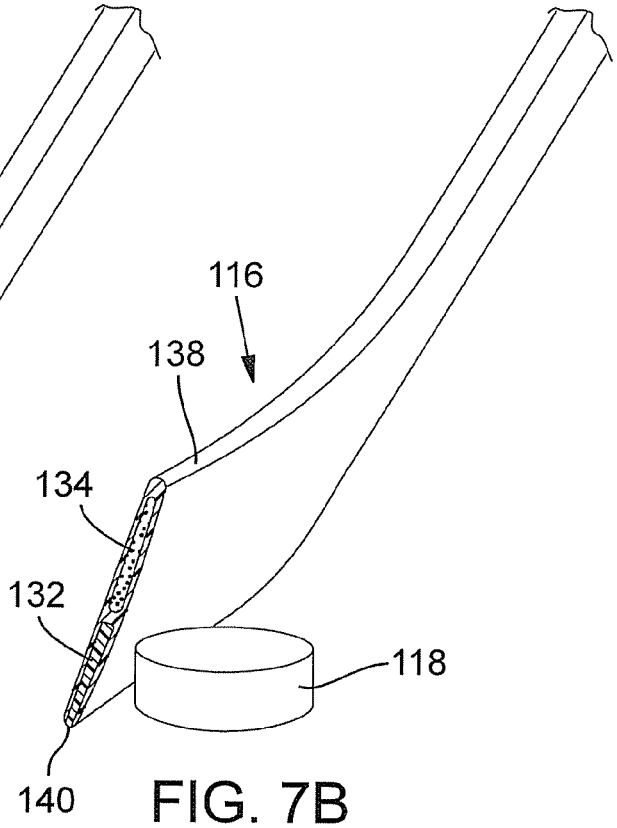
FIG. 7B is a section view of the hockey stick of FIG. 7A shown during resilient compression.

Referring now to FIGS. 7A and 7B, additional embodiments of the blade portion 116 of the hockey stick 110 will be discussed. Components that correspond to the embodiments discussed above are indicated with corresponding reference numbers increased by 100.

As shown in FIG. 7A, the hockey stick 110 can include a first core member 132 and a second core member 134. The core members 132, 134 can each have substantially rectangular cross sections. The second core member 134 can be disposed over (i.e., overlap) the first core member 132. As shown in FIG. 7B, the hockey stick 110 can resiliently compress when the puck 118 impacts the blade portion 116 due to the inclusion of the first core member 132 and the opening 140 in the covering member 138.

In some additional embodiments, the first core member 32, 132 contrasts visually with the surrounding covering member 38, 138. For instance, the first core member 32, 132 can have a bright color while the covering member 38, 138 has a dark color, or vice versa. Such contrast can provide a visual indication of the presence of the first core member 32, 132 within the blade portion 16, 116. Thus, the user can quickly distinguish the hockey stick 10, 110 from others that do not include a first core member 32, 132.

Additional embodiments, which are not illustrated, will now be discussed. For instance, the hockey stick 10 can include core members 32, 34, 36 with other shapes. Specifically, in some embodiments, the hockey stick 10 can include a resiliently compressible first core member 32 that has a cross section resembling a right triangle, wherein a long side of the triangle is arranged adjacent the front face 20, the short side of the triangle is arranged adjacent the lower edge 26, and the hypotenuse of the triangle extends generally from the intersection of the front face 20 and upper edge 24 and the intersection of the rear face 22 and lower edge 26. In this embodiment, the hockey stick 10 can also include a lightweight, stiff second core member 34 that is also triangular in cross section. The second core member 34 can be inverted with respect to the first core member 32, and the respective hypotenuse of each of the core members 32, 34 can be disposed adjacent each other with only the internal portion 44 of the covering member 38 disposed therebetween.

Accordingly, the blade portion 16, 116 of the hockey stick 10, 110 can be resiliently compressible. This can allow the stick 10, 110 to better absorb energy (e.g., from impact of the puck 18, 118), and the puck 18 is less likely to inadvertently bounce away from the stick 10, 110. Thus, the player can better control the puck 18, 118. Moreover, the blade portion 16, 116 can resiliently compress and releasably return to its neutral position, and this energy can be transferred to the puck 18, 118 for added velocity during shooting and passing. Moreover, even though the first core member 32, 132 might be made from an elastomer, the weight of the blade portion 16, 116 can remain relatively low, for instance, because the core member 32, 132 can have an L-shaped cross section.

Additionally, in some embodiments, the compressibility of the first core member 32, 132 can be varied among different hockey sticks 10, 110. As such, the hockey stick 10, 110 can be customized for different players 14.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A blade for a hockey stick, the blade including a front face, a rear face, a first end operable to be connected to a blade connecting end of a handle portion, a second end that is opposite the first end, an upper edge that extends between the first and second ends, and a lower edge that extends between the first and second ends, the blade comprising:

a resiliently compressible core member; and a covering member that partially encases the resiliently compressible core member and that defines an exterior surface of the blade, the covering member including an opening on the lower edge of the blade that exposes the resiliently compressible core member;

wherein the opening is located only on the lower edge of the blade.

2. The blade of claim 1, further comprising at least one rigid core member that is at least partially encased by the covering member.

3. The blade of claim 2, wherein the at least one rigid core member includes a rigid foam.

4. The blade of claim 2, further comprising a rib that is disposed between the at least one rigid core member and the resiliently compressible core member, the rib and the covering member being integrally connected, the rib extending between the front and rear faces.

5. The blade of claim 2, wherein the resiliently compressible core member and the at least one rigid core member at least partially overlap between the front and rear faces.

6. The blade of claim 5, wherein the resiliently compressible core member is disposed closer to the front face than the at least one rigid core member.

7. The blade of claim 2, wherein the at least one rigid core member includes a first rigid core member and a second rigid core member, the first rigid core member overlapping the resiliently compressible core member and the second rigid core member between the upper and lower edges.

8. The blade of claim 1, wherein the resiliently compressible member includes an elastomeric material.

9. The blade of claim 8, wherein the elastomeric material is at least one of polyurethane, silicone, neoprene, and rubber.

10. The blade of claim 1, wherein the covering member includes a plurality of woven carbon fibers that are embedded within a matrix material.

11. A blade for a hockey stick, the blade including a front face, a rear face, a first end operable to be connected to a blade connecting end of a handle portion, a second end that is opposite the first end, an upper edge that extends between the first and second ends, and a lower edge that extends between the first and second ends, the blade comprising:

a resiliently compressible core member; and a covering member that partially encases the resiliently compressible core member and that defines an exterior surface of the blade, the covering member including an opening on the lower edge of the blade that exposes the resiliently compressible core member;

wherein the resiliently compressible core member includes a bottom rib and a front sheet, the bottom rib being exposed through the opening, the front sheet being adjacent the front face.

12. A method of manufacturing a blade for a hockey stick, the blade including a front face, a rear face, a first end operable to be connected to a blade connecting end of a handle portion, a second end that is opposite the first end, an upper edge that extends between the first and second ends, and a lower edge that extends between the first and second ends, the method comprising:

providing a resiliently compressible core member; and partially encasing the resiliently compressible core member with a covering member to define an exterior surface of the blade, and to leave the resiliently compressible core member partially exposed through an opening in the covering member located only on the lower edge of the blade.

13. The method of claim 12, further comprising providing at least one rigid core member, and at least partially encasing the at least one rigid core member with the covering member.

14. The method of claim 13, wherein the at least one rigid core member includes a rigid foam.

15. The method of claim 12, wherein the resiliently compressible core member includes a bottom rib and a front sheet, and wherein partially encasing the resiliently compressible core member includes exposing only a lower edge of the bottom rib through the opening.

16. The method of claim 12, wherein the resiliently compressible member includes an elastomeric material.

17. The method of claim 16, wherein the elastomeric material is at least one of polyurethane, silicone, neoprene, and rubber.

18. The method of claim 12, wherein partially encasing the resiliently compressible core member includes wrapping a pre-preg of the covering member over the resiliently compressible core member and curing the pre-preg.

19. A hockey stick comprising:

a handle portion with a blade connecting end; and a blade including a front face, a rear face, a first end operable to be connected to the blade connecting end of the handle portion, a second end that is opposite the first end, an upper edge that extends between the first and second ends, and a lower edge that extends between the first and second ends, the blade further including:

an elastomeric core member that includes a bottom rib and a front sheet, the bottom rib disposed adjacent the lower edge of the blade, and the front sheet adjacent to and extending along the front face of the blade, at least one rigid foam member, and a covering member that at least partially encases the at least one rigid foam member and the elastomeric core member, the covering member defining an exterior surface of the blade, the covering member including an opening on the lower edge of the blade that exposes the bottom rib of the elastomeric core member along the lower edge of the blade.

20. The blade of claim 1 wherein the covering member covers a first portion of the lower edge of the blade at said first end and a second portion of the lower edge of the blade at said second end such that said opening extends between said first and second portions.

* * * * *